US005492045A

United States Patent [19]

Roblee

[11] Patent Number: 5,492,045

[45] Date of Patent: Feb. 20, 1996

[54] QUICK RELEASE CAPO FOR STRINGED INSTRUMENT

[76] Inventor: Todd A. Roblee, 400 Cavender Ct., Hurst, Tex. 76054

[21] Appl. No.: 192,558

[22] Filed: Feb. 7, 1994

[51] Int. Cl.[6] ..... G10D 3/04

[52] U.S. Cl. ..... 84/318

[58] Field of Search ..... 84/318, 317, 316, 84/315, 319; D17/20; 81/487; 269/166, 167, 170, 169

[56] References Cited

U.S. PATENT DOCUMENTS

| | | | |
|---|---|---|---|
| 7,279 | 4/1850 | Ashborn | 84/318 |
| 134,679 | 1/1873 | Knaffl | 84/318 |
| D. 257,988 | 1/1981 | Nakamoto | 84/318 |
| D. 281,508 | 11/1985 | McKinney, III | 84/318 |
| 370,172 | 9/1887 | Wood | 84/318 |
| 390,612 | 10/1888 | Moffat | 84/318 |
| 402,577 | 5/1889 | Filstrup | 84/318 |
| 416,057 | 11/1889 | Gill et al. | 84/318 |
| 439,230 | 10/1890 | Ximenes | 84/458 |
| 452,639 | 5/1891 | Gatchell | 269/4 |
| 468,193 | 2/1892 | Dahlman et al. | 84/318 |
| 480,429 | 8/1892 | Johnsen | 84/318 |
| 489,525 | 1/1893 | Dahlman | 84/318 |
| 513,165 | 1/1894 | Whelan et al. | 84/318 |
| 536,563 | 3/1895 | Converse | 84/454 |
| 545,963 | 9/1895 | Ling | 84/317 |
| 551,254 | 10/1895 | Brand | 84/318 |
| 577,627 | 2/1897 | Schuster | 84/318 |
| 583,102 | 5/1897 | Utt | 84/318 |
| 589,658 | 9/1897 | Kelman | 84/317 |
| 608,278 | 8/1898 | Benson | 84/318 |
| 620,560 | 3/1899 | Averitt | 84/318 |
| 652,520 | 6/1900 | Pletcher | 84/318 |
| 656,904 | 8/1900 | Pletcher | 84/318 |
| 743,054 | 11/1903 | Bergren | 84/318 |
| 753,327 | 3/1904 | Sprotte | 84/454 |
| 757,251 | 4/1904 | Berglund | 84/317 |
| 759,057 | 5/1904 | Almcrantz et al. | 84/318 |
| 775,399 | 11/1904 | Halladay | 84/318 |
| 957,681 | 5/1910 | John | 84/315 |
| 1,094,038 | 4/1914 | Weaver et al. | 84/317 |
| 1,120,091 | 12/1914 | Schmidt | 84/317 |
| 1,518,719 | 12/1925 | Whiteman | 84/318 |
| 1,697,508 | 1/1929 | Kordick | 84/319 |
| 1,772,725 | 8/1930 | Lewis | 84/310 |
| 1,788,636 | 1/1931 | Russell | 84/318 |
| 1,823,683 | 9/1931 | Gardner, Jr. | 84/318 |
| 2,132,281 | 10/1938 | Adamson | 84/317 |
| 2,450,210 | 9/1948 | Sprague | 84/317 |
| 2,669,151 | 2/1954 | Maccaferri | 84/317 |
| 2,744,433 | 5/1956 | Rooms | 84/315 |
| 2,746,337 | 5/1956 | Smit | 84/317 |
| 2,790,344 | 4/1957 | Brimhall | 84/317 |
| 2,798,398 | 7/1957 | Hayes | 84/317 |
| 2,961,913 | 11/1960 | Popkin | 84/315 |
| 3,011,380 | 12/1961 | Brimhall | 84/317 |
| 3,020,734 | 2/1962 | Withers | 63/14.4 |
| 3,129,626 | 4/1964 | Granius | 84/317 |
| 3,154,994 | 11/1964 | Blohm | 84/317 |
| 3,185,012 | 5/1965 | Dunlop | 84/318 |
| 3,205,751 | 9/1965 | Lowe | 84/318 |
| 3,227,028 | 1/1966 | Simms | 84/318 |
| 3,230,816 | 1/1966 | Jira | 84/315 |
| 3,277,765 | 10/1966 | Miller | 84/318 |
| 3,422,717 | 1/1969 | Roussel | 84/317 |
| 3,446,108 | 5/1969 | Mitchell, Jr. | 84/317 |

(List continued on next page.)

*Primary Examiner*—Cassandra C. Spyrou
*Attorney, Agent, or Firm*—L. Dan Tucker

[57] ABSTRACT

A capo for fretting the neck of a stringed instrument, comprising a barr member for fretting the strings, a housing member coupled to the barr member, a forcing member for engaging the neck on a side of the neck substantially opposite the strings, a slide bar coupled to the forcing member, first biasing member disposed between the housing and the slide bar and operable to bias the slide bar in a direction away from the neck, a braking lever pivotally engaged with the housing, the braking lever having an opening through which the slide bar passes and second biasing member operable to bias the braking lever in a direction away from the neck. Other systems, devices and methods are disclosed.

8 Claims, 3 Drawing Sheets

U.S. PATENT DOCUMENTS

| | | | |
|---|---|---|---|
| 3,504,589 | 4/1970 | Wowries | 84/318 |
| 3,568,560 | 3/1971 | Chang et al. | 84/317 |
| 3,598,012 | 8/1971 | Dunlop | 84/318 |
| 3,647,930 | 3/1972 | Wowries | 84/318 |
| 3,680,427 | 8/1972 | Valentino | 84/318 |
| 3,682,036 | 8/1972 | Null et al. | 84/317 |
| 3,704,646 | 12/1972 | Davis et al. | 84/318 |
| 3,722,346 | 3/1973 | Valentino | 84/318 |
| 3,776,088 | 12/1973 | Jones | 84/317 |
| 3,805,664 | 4/1974 | Starns | 84/317 |
| 3,818,793 | 6/1974 | Round | 84/454 |
| 3,834,267 | 9/1974 | Shubb et al. | 84/318 |
| 3,915,051 | 10/1975 | Kincaid | 84/318 |
| 3,933,073 | 1/1976 | Hutchins | 84/318 |
| 3,933,077 | 1/1976 | Dunlop | 84/318 |
| 3,971,287 | 7/1976 | Ito | 84/318 |
| 3,995,523 | 12/1976 | Clarke | 84/317 |
| 4,030,400 | 6/1977 | Del Castillo | 84/317 |
| 4,048,894 | 9/1977 | Myerson et al. | 84/318 |
| 4,104,947 | 8/1978 | Oster | 84/318 |
| 4,143,576 | 3/1979 | Nichols et al. | 84/318 |
| 4,149,443 | 4/1979 | Bringe | 84/318 |
| 4,154,134 | 5/1979 | Schreiber | 84/317 |
| 4,165,670 | 8/1979 | Cahn | 84/318 |
| 4,168,648 | 9/1979 | Ronca | 84/318 |
| 4,183,279 | 1/1980 | Shabram, Jr. | 84/318 |
| 4,250,790 | 2/1981 | Shubb et al. | 84/318 |
| 4,252,046 | 2/1981 | Myerson et al. | 84/318 |
| 4,304,165 | 12/1981 | Gould | 84/318 |
| 4,324,165 | 4/1982 | Wilkerson | 84/318 |
| 4,331,059 | 5/1982 | Marabotto | 84/318 |
| 4,334,457 | 6/1982 | Spoonts, III | 84/318 |
| 4,412,472 | 11/1983 | Welch | 84/318 |
| 4,475,433 | 10/1984 | Williamson et al. | 84/318 |
| 4,503,747 | 3/1985 | Labbe | 84/318 |
| 4,583,440 | 4/1986 | Powell, Jr. | 84/318 |
| 4,621,558 | 10/1986 | Cornette | 84/318 |
| 4,671,156 | 6/1987 | Hathcock | 84/318 |
| 4,823,670 | 4/1989 | Gherman et al. | 84/318 |
| 4,926,722 | 5/1990 | Sorensen et al. | 81/487 |
| 4,926,732 | 5/1990 | Collins et al. | 84/318 |
| 5,005,449 | 4/1991 | Sorensen et al. | 81/152 |
| 5,117,723 | 6/1992 | Veenschoten | 84/318 |

QUICK RELEASE CAPO FOR STRINGED INSTRUMENT

TECHNICAL FIELD OF THE INVENTION

The present invention relates generally to capos for stringed instruments, and more particularly to a quick release capo for stringed instruments.

BACKGROUND OF THE INVENTION

While the present invention may be used in conjunction with any stringed instrument, such as a guitar, mandolin, banjo, dobro, lute, violin, cello, bass, etc., it will be described herein with reference to its application to a guitar for convenience of description. Additionally, while the description herein may refer to a fretted instrument, it will be appreciated by those skilled in the an that the present invention is equally applicable to non-fretted instruments.

Referring to FIG. 1, it will be appreciated that on stringed instruments such as guitars, a plurality of strings 10 extend in parallel juxtaposition along the upper surface of a long slender neck 12. These strings 10 are plucked or strummed by the player with the fingers of one of his hands, and the different notes are established by pressure of the fingertips of his other hand against the strings 10 at different points longitudinally thereof. There are different types of guitars; the most prevalent one is the Spanish guitar in which the upper surface of the neck 12 is provided with many frets 14, or thin metal strips, that extend transversely across the neck 12 of the guitar and which are spaced from each other in a direction longitudinally of the neck 12. The strings 10 of such guitars are arranged to extend slightly above these frets 14 and the frets 14 assist the player in locating the proper place for his fingers for establishing a certain note, which he does when he presses his finger or fingers against a string or strings 10 in order to force the strings 10, individually or as a group, against selected frets 14 or against the upper surface of the neck 12 of the guitar at a point slightly in front of a selected fret 14 (i.e. in front as viewed in a direction looking toward the bridge of the guitar). This action is known as "fretting." Fretting changes the effective length of the fretted strings so that vibration of each string 10 will result in a sound of a predetermined frequency, different from the sound that will be produced when the string 10 is forced against any other fret 14.

In the past, many guitar players have produced such fretting by employing a device known as a capotasto 16 (referred to hereinafter as a "capo"). Capotasto is an Italian word meaning literally "the head of the guitar." In general, a capo 16 acts to move the effective head of the guitar by pressing a barr 18 against the strings 10 of the guitar at a selected position along the length of the neck 12, thereby shortening the effective vibrating length of the strings 10 and altering the pitch thereof. The barr 18 is usually held in place by means of an elastic band or other tying device 20 which prevents movement of the barr 18 relative to the neck 12. When the capo 16 is mounted on the neck 12 of the guitar, it presses the strings 10 against the next lower fret 14 so that each time one of the strings 10 is plucked or strummed, it will produce a sound of predetermined frequency depending upon the fret 14 selected, unless the string 10 is also individually fretted at a lower position by a finger of the player. In other words, a capo 16 will effectively change the tuning of the guitar by shortening the effective length of the strings 10, without requiring that each string 10 be individually retuned. In this way, the key of the guitar may be easily changed without retuning.

When certain musical selections are played, however, it is sometimes desirable to fret all of the strings 10 at a predetermined position only temporarily and to relieve the fretting after a selected number of notes or chords have been played. In such cases it has become common for players to utilize the index finger of the hand which controls the fretting of the strings 10 to accomplish a fretting of all the strings 10 at a predetermined position. While this is accomplished, the remaining three fingers of the hand may be used to individually fret up to three of the strings 10 at lower positions. Such frettings are commonly known as "barr chords."

Unfortunately, not all players find it comfortable or convenient to accomplish such barr chord fretting. Many have difficulty arranging their hands and arms in such a way that their index fingers can be properly positioned to accomplish the fretting, while allowing the remaining three fingers to curve sufficiently to achieve independent string fretting without touching any of the other strings 10, thereby reducing the quality of the sound of such other strings 10. Further, many players find it undesirable to fret all of the strings 10 with their index finger, preferring to use four fingers instead to fret individual strings 10. Of particular importance is the fact that a capo 16 makes it easier for players of limited experience to play in higher keys since the same fingering as in the basic key may be used in the higher keys established by the capo 16 without the need to resort to barr chords.

When a capo is in use on an instrument neck 12, it is desirable that its string engaging portion 18 securely and tightly press the strings 10 against the surface of the fingerboard 22 regardless of whether or not the fingerboard 22 includes frets 14. This requires that the capo 16 be secured to the neck 12 with considerable force, and in previous capo 16 constructions this force has been obtained through the use of relatively cumbersome devices using screws, toggle levers, springs, elastic bands, etc. which were difficult to handle or time consuming to manipulate. In particular, the construction of previous capos 16 have generally been such that the acts of attaching one to an instrument neck 12, removing it from the neck 12, or shifting it from one position to another along the neck 12 have required the use of two hands and have further required the performer to shift the instrument from its normal playing position.

There is therefore a need in the prior art for a capo that may be rapidly applied to the neck of the instrument, rapidly removed therefrom, and rapidly shifted to a second position of the instrument, where application of the capo to the neck is accomplished with an amount of pressure easily controlled by the player using one hand. The present invention is directed toward meeting these needs by providing an improved capo which includes a simple rapid application and rapid release clamping mechanism. Such a clamping mechanism allows the capo to be rapidly applied, released or shifted relative to an instrument neck by a simple one-handed manual operation without moving the instrument from its normal playing position, thereby allowing the capo to be quickly applied, released or shifted, and enabling such changes to be made during a performance, if need be, without substantial interruption of the performance.

SUMMARY OF THE INVENTION

It is therefore the object of the present invention to provide an improved capo which includes a simple rapid application and rapid release clamping mechanism allowing it to be rapidly applied, released or shifted relative to an instrument neck by a simple one-handed manual operation without moving the instrument from its normal playing position, thereby allowing the capo to be quickly applied, released or shifted, and enabling such changes to be made during a performance, if need be, without substantial interruption of the performance.

In order to meet the forgoing objective and to overcome the problems inherent in the prior an devices, the present invention incorporates a novel slide bar and braking lever mechanism which incorporates a quick release function.

In one form of the invention, a capo for fretting the neck of a stringed instrument is disclosed, comprising a barr member for fretting the strings, a forcing member for engaging the neck on a side of the neck substantially opposite the strings, a slide bar coupled to the forcing member and releasable locking means operable in a first position to allow movement of the slide bar toward the neck and away from the neck, and further operable in a second position to allow movement of the slide bar toward the neck and to prevent movement of the slide bar away from the neck.

In another form of the invention, a capo for fretting the neck of a stringed instrument is disclosed, comprising a barr member for fretting the strings, a housing member coupled to the barr member, a forcing member for engaging the neck on a side of the neck substantially opposite the strings, a slide bar coupled to the forcing member, first biasing means disposed between the housing and the slide bar and operable to bias the slide bar in a direction away from the neck, a braking lever pivotally engaged with the housing, the braking lever having an opening through which the slide bar passes and second biasing means operable to bias the braking lever in a direction away from the neck.

In another form of the invention, a capo for fretting the neck of a stringed instrument is disclosed, comprising a barr member for fretting the strings, a housing member coupled to the barr member, a forcing member for engaging the neck on a side of the neck substantially opposite the strings, a slide bar coupled to the forcing member, first biasing means disposed between the housing and the slide bar and operable to bias the slide bar in a direction away from the neck, a detent, at least one notch in the slide bar wherein the notch is positioned to engage the detent at at least one predetermined position of the slide bar and second biasing means operable to bias the detent in a direction toward the notch when the detent and the notch are aligned.

In another form of the invention, a method for fretting the neck of a stringed instrument at a predetermined fret is disclosed, comprising the steps of (a) placing a capo on the neck at the predetermined fret; (b) grasping a barr member of the capo with the fingers of one hand; (c) placing the thumb of the hand on an end of a slide bar of the capo, the slide bar operable to slide in a direction substantially orthogonal to the barr member; (d) squeezing the thumb and fingers toward one another until the capo frets the strings; and (e) removing the thumb and fingers from the capo.

BRIEF DESCRIPTION OF THE DRAWINGS

The novel features believed to be characteristic of the invention are set forth in the appended claims. For a more complete understanding of the present invention, and for further details and advantages thereof, reference is now made to the following Detailed Description taken in conjunction with the accompanying drawings, in which:

It is to be expressly understood, however, that the drawings are for purposes of illustration only and are not intended as a definition of the limits of the invention. Such definition is made only by the appended claims.

DETAILED DESCRIPTION OF THE DRAWINGS

Figure 1:
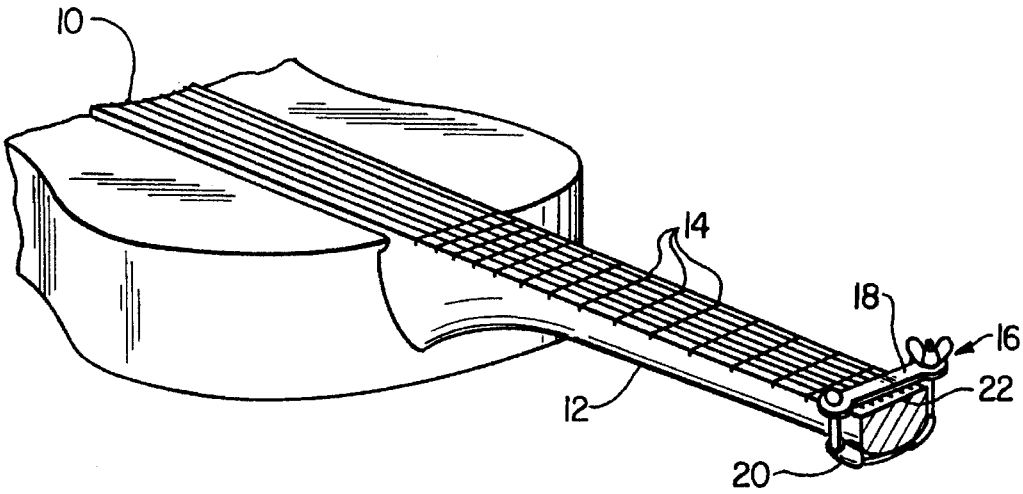
FIG. 1 (PRIOR ART)
FIG. 1 is a partial cross-sectional view of a prior art capo installed on the neck of a guitar.
Figure 2:
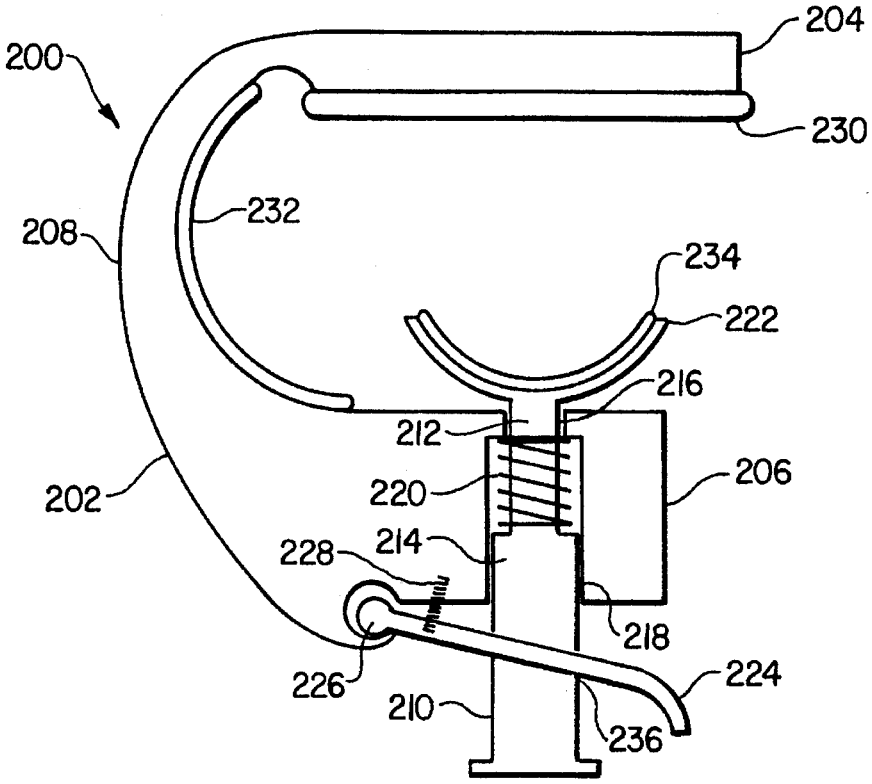
FIG. 2 is a cross-sectional view of a first embodiment capo of the present invention.

The present invention relates to capos for stringed instruments. A first embodiment of the capo of the present invention is illustrated in FIG. 2, and indicated generally at 200. Capo 200 is not drawn to scale in order to provide for clearer illustration of the novel aspects of the present invention. A generally C-shaped body 202 of capo 200 includes a string compression or ba member 204 and a slide bar cover or housing member 206. Members 204 and 206 are disposed in a substantially parallel arrangement and are coupled by arm 208. Slide bar cover member 206 contains a cavity therethrough, said cavity being substantially perpendicular to the string compression member 204. A slide bar 210 is disposed within the cavity and is operative to slide therethrough along a longitudinal axis of the cavity. Slide bar 210 has a narrow portion 212 and a wide portion 214. The cavity in which slide bar 210 is disposed has a corresponding narrow portion 216 and wide portion 218, the dimensions of the slide bar 210 being slightly smaller than the corresponding dimensions of the cavity in order to facilitate the movement of slide bar 210 through the cavity.

A spring, or biasing member, 220 is held within the space defined by the narrow cavity portion 216 and the transition between the narrow and wide portions of slide bar 210. Spring 220 is shown in its relaxed position in FIG. 2. Upward movement of the slide bar 210 operates to compress the spring 220. The narrow portion 212 of slide bar 210 is coupled to a curved or forcing member 222. The wide portion 214 of slide bar 210 passes through an opening (see 300, FIG. 3) in brake lever 224. Brake lever 224 is pivotally engaged with body 202 at socket joint 226. A second spring 228 is coupled to slide bar cover member 206 and to brake lever 224 and is operative to bias brake lever 224 away from slide bar cover member 206. Pads 230, 232 and 234 are respectively coupled to string compression member 204, arm 208 and curved member 222. Pads 230, 232 and 234 operate to prevent damage to the stringed instrument when capo 200 is installed thereon. Additionally, the pad 230 may be slidingly engaged on the member 204 such that when the pad 230 is slid slightly to the fight in FIG. 2, one or more strings 10 will remain unfretted when the capo 200 is installed. Additionally, pad 230 may be sized to be smaller than the neck 12 of the guitar, or to be notched, so that selective strings 10 may be fretted by the application of capo 200.

The capo 200 is operated by positioning it over the neck of a guitar or other stringed instrument such that the string compression member 204 overlays the guitar neck at the point where it desired to barr the strings. The player's left hand may then be used to squeeze slide bar 210 towards string compression member 204 until the capo 200 is in place. Strumming the strings of the guitar with the player's right hand while performing this operation will result in the strings sounding when the capo 200 firmly in place. Squeezing can stop at that time. When the slide bar 210 is squeezed by the player, the slide bar 210 transmits force to the braking lever 224 at point 236 where they normally touch. This force operates to push braking lever 224 towards slide bar cover member 206, compressing spring 228. With the braking lever in this position, the slide bar 210 easily slides through the opening in braking lever 224 through which slide bar 210 passes.

However, once the capo 200 is installed and there is no further movement of the slide bar 210, spring 228 biases the braking lever 224 away from slide bar cover member 206. This causes the braking lever 224 and the slide bar 210 to engage at point 236. This engagement at point 236 prevents the slide bar 210 from moving in the direction away from the slide bar cover member 206, even though the compressed spring 220 is urging it to do so. The capo 200 is therefore locked onto the neck of the guitar by braking lever 224.

In order to release the capo 200 from the neck of the guitar, the player simply squeezes the braking lever 224 towards the slide bar cover member 206, thereby compressing the spring 228. In this position, there is no longer contact at point 236 and the slide bar 210 is free to move. The force from compressed spring 220 causes slide bar 210 to return to its starting position where the spring 220 is not compressed.

Figure 3:
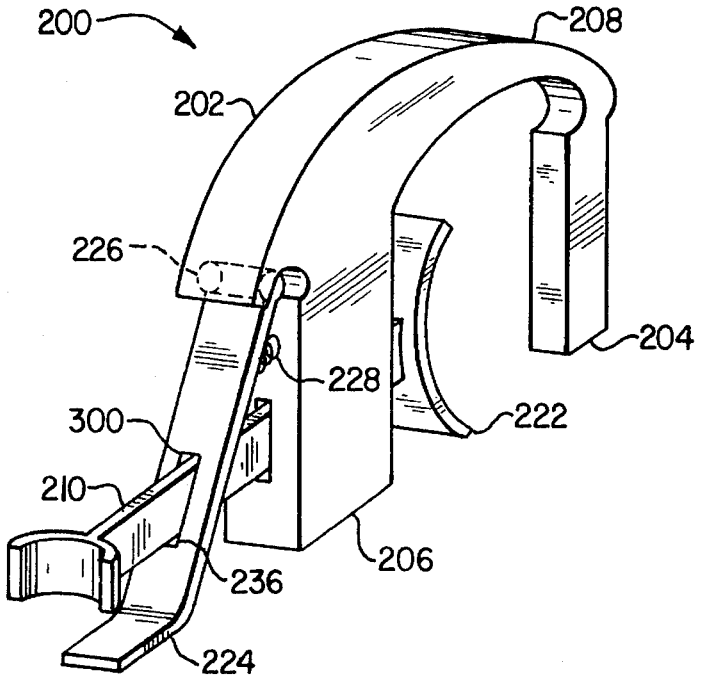
FIG. 3 is a perspective view of the capo of FIG. 2.

Referring now to FIG. 3, the capo 200 is illustrated in a three-dimensional perspective that more clearly shows the engagement of the braking lever 224 with the slide bar 210. It will be appreciated by those skilled in the art that the opening 300 is sized so that slide bar 210 may easily pass therethrough when braking lever 224 is depressed toward slide bar cover member 206, compressing the spring 228. However, when braking lever 224 is not being forced toward the slide bar cover member 206, the spring 228 forces it in the opposite direction, bringing the slide bar 210 and the braking lever into contact at point 236. The force thereby applied between braking lever 224 and slide bar 206 is great enough to prevent slide bar 210 from being pushed out of cover member 206 by spring 220 (see FIG. 2). In fact, the force applied by the braking lever 224 is so great that the slide bar 210 cannot even be pulled out by the application of human strength to the slide bar 210.

Figure 4:
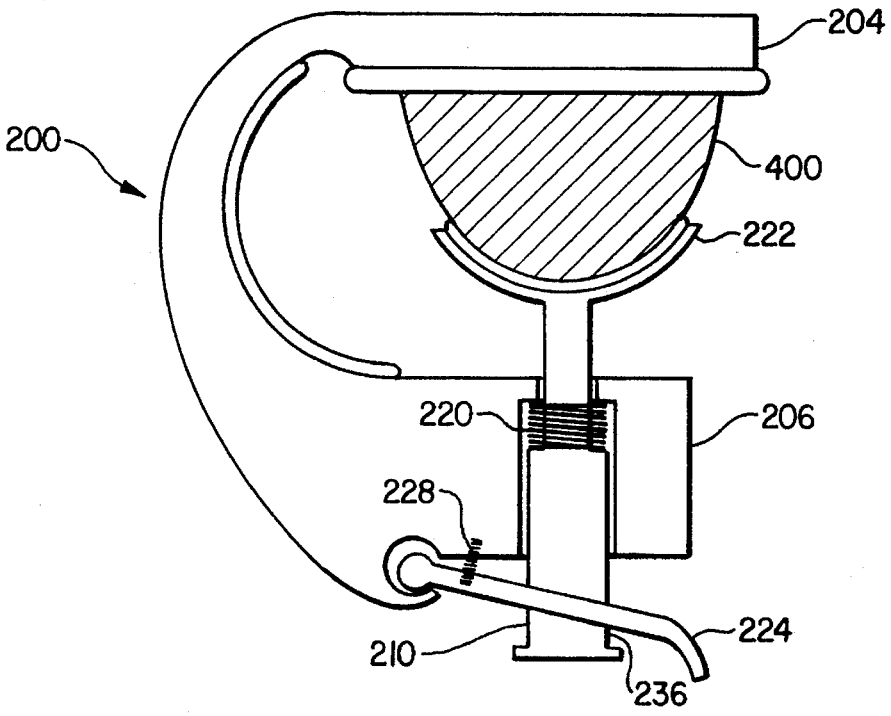
FIG. 4 is a cross-sectional view of the capo of FIG. 2 installed on the neck of a guitar.

Referring now to FIG. 4, the capo 200 is shown in cross-section installed on the neck of a guitar 400. It will be appreciated by those skilled in the art that even though spring 220 is compressed and exerting a force which attempts to push the slide bar 210 out of the cover member 206, the braking lever 224 prevents this by means of the force applied at point 236. Braking lever 224 remains engaged with slide bar 210 at point 236 because of the biasing force applied to the braking lever 224 by spring 228. However, once the braking lever 224 is depressed toward the cover member 206 by the player, the spring 220 will operate to return the slide bar 210 back to its initial position, releasing the capo's grip on the neck 400.

It will be appreciated by those skilled in the art that the design of the present invention represents a significant leap forward in the state of the art by allowing extremely simple, one-handed mounting and removal of the capo 200. This is a welcome convenience for any player, but it represents a significant advantage to the performer who desires to change the key of his instrument during a performance. With a capo 200 embodying the present invention, such a player simply places the capo 200 over the neck of the guitar, positions it at the position desired to be fretted, and squeezes the slide bar 210. Because the installation of capo 200 is effectuated by the same hand that the performer uses to fret the strings normally, when the same amount of fretting pressure is applied to the capo 200 instead of to the strings 10, this will insure that the capo 200 is properly fitted and tight enough to fret the strings 10.

If at some point in the performance it is necessary to refret the guitar (i.e. change its key), the performer simply squeezes braking lever 224 and the spring 220 automatically disengages curved member 222 from the neck of the guitar. The capo 200 may then be easily repositioned on the guitar neck. Squeezing the slide bar 210 once more securely fastens the capo 200 at the new location. On the other hand, if the performer wishes to remove the capo completely in order to restore the guitar to its original (open) tuning, a quick depression of the braking lever 224 will release the capo 200 and it may be removed from the neck of the guitar.

Such ease of operation allows the performer to install or change the position of the capo 200 between songs without drawing undue attention to the operation from the audience, or to reposition the capo 200 any number of times during the song with very little loss of playing time. Prior art devices would allow such repositioning only when there was a relatively extended time during the performance when it was not necessary for the guitarist to play. Additionally, prior art capos required a relatively high level of dexterity, strength and concentration for adjustment that virtually precluded the guitarist to continue singing while repositioning the capo.

An additional advantage of the capo 200 is that it provides greater tuning stability than prior art capos. This is due to the fact that prior art capos use a large amount of pressure to hold the capo on the neck of the guitar. This excess pressure has a tendency to pull the strings 10 out of their original tension, thereby causing them to go out of tune. Because only normal fretting pressure is exerted by the present capo 200 on the neck and strings, the capo 200 will not cause the strings to go out of tune. Furthermore, the capo 200 of the present invention has the advantage that the adjustable pressure feature of the invention will prevent damage to the neck of the guitar by allowing the user to apply only that amount of pressure needed to properly affix the capo to the neck of the guitar. For all of the these reasons, the capo 200 of the present invention represents a significant improvement over the prior art capo designs.

Figure 5:
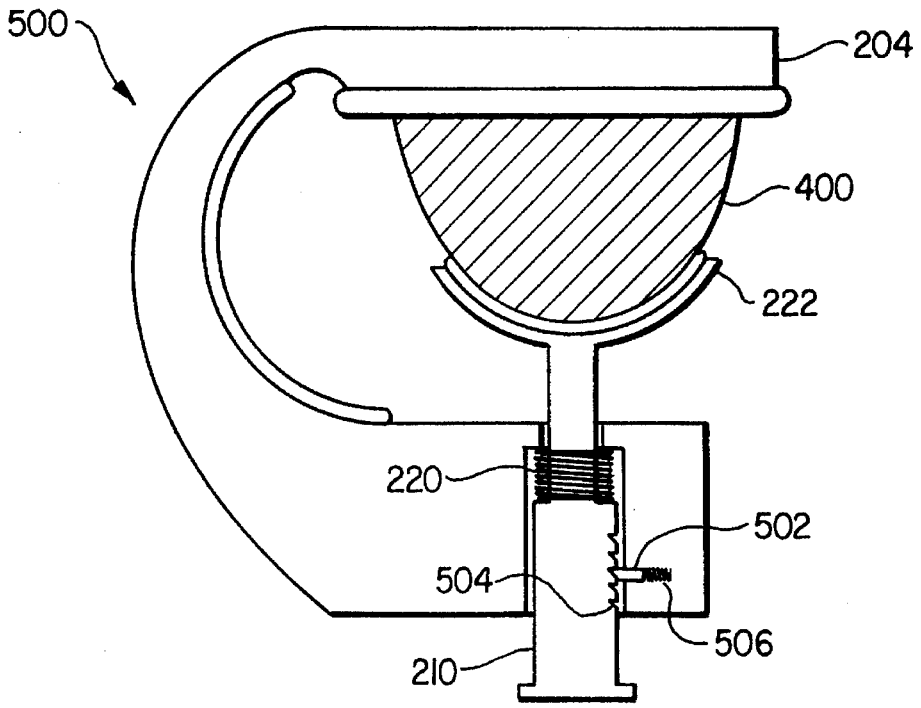
FIG. 5 is a cross-sectional view of a second embodiment capo installed on the neck of a guitar.

Referring now to FIG. 5, there is illustrated a second embodiment capo of the present invention, indicated generally at 500. The capo 500 is similar to the capo 200 of FIG. 2, except that the braking lever 224/spring 228 arrangement has been replaced with a detent 502 which engages a series of notches 504 formed into one edge of the slide bar 210. The detent 502 is biased toward the notches 504 by means of a spring 506 such that the biasing force of the spring 506 forces the detent 502 into engagement with any notch 504 aligned therewith. The surfaces of detent 502 and notches 504 which face away from curved member 222 are formed at an angle so that movement of the slide bar 210 towards the neck 400 of the guitar causes the detent to be depressed toward the spring 506, thereby making room for the slide bar 210 to pass. Once the next notch 504 is aligned with the detent 502, spring 506 biases the detent 502 back into engagement with the aligned notch 504.

Because the surfaces of detent 502 and notches 504 which face the curved member 222 are not formed at an angle, no such movement of the slide bar is possible in the direction away from curved member 222, because the engagement of the detent 502 with the aligned notch 504 prevents such movement even though the compressed spring 220 biases the slide bar 210 in that direction. If the notches 504 are made sufficiently small and close together, a high degree of adjustability of the slide bar 210 is thereby achieved.

Figure 6:
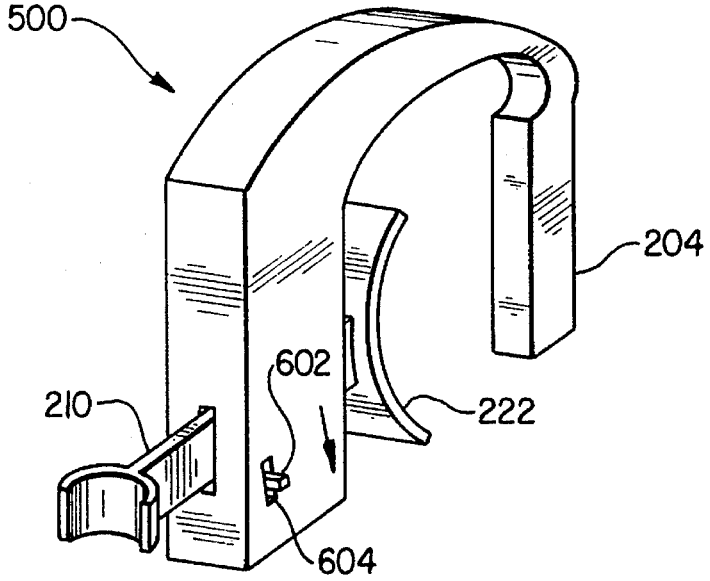
FIG. 6 is a perspective view of the capo of FIG. 5.

Referring now to FIG. 6, the capo 500 is illustrated in perspective view. A release lever 602 is illustrated emerging from slot 604. The release lever 602 is coupled to the detent 502 so that movement of the release lever 602 in the direction indicated by the arrow operates to move the detent 502 away from the notch 504, thereby depressing spring 506. Such movement of the detent 502 allows the compressed spring 220 (see FIG. 5) to operate to move the slide bar 210 in the direction away from curved member 222, thereby releasing the capo 500's grip on the neck of the guitar.

It will be appreciated by those skilled in the art that the capo 500 incorporates a ratcheting system for allowing adjustment of the slide bar 210 in one direction, locking of the slide bar 210 once said adjustment in completed, and operator controlled releasing of slide bar 210 at some later time. Consequently, the present invention comprehends any similar releasable locking arrangements.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. For example, the biasing spring 220 of FIG. 2 may be located in any position that will tend to force the slide bar 210 out of the cover member 206 after installation, such as between the braking lever 224 and the ranged end of slide bar 210. As another example of a modification that is within the scope of the present invention, the spring 228 may be placed at any position that will tend to bias the braking lever 224 against the slide bar 210, such as on the opposite side of slide bar 210 as that shown in FIG. 2. Accordingly, the present invention is intended to encompass such rearrangements, modifications, and substitutions of pans and elements as fall within the scope of the appended claims.

What is claimed is:

1. A capo for fretting an instrument having a neck and strings, comprising:

a housing;

a barr member coupled to said housing for fretting said strings;

a forcing member for engaging said neck on a side of said neck substantially opposite said strings;

a slide bar coupled to said forcing member;

releasable locking means operable in a first position to allow movement of said slide bar toward said neck and away from said neck, and further operable in a second position to allow movement of said slide bar toward said neck and to prevent movement of said slide bar away from said neck; and biasing means disposed between said housing and said slide bar operable to bias said slide bar in a direction away from said neck.

2. The capo of claim 1 wherein said biasing means comprises a spring.

3. The capo of claim 1 wherein said releasable locking means comprises:

a braking lever pivotally engaged with a housing around said slide bar, said braking lever having an opening through which said slide bar passes; and biasing means operable to bias said braking lever in a direction away from said neck.

4. The capo of claim 3 wherein movement of said slide bar toward said neck causes said braking lever to compress said biasing means, thereby allowing unrestricted movement of said slide bar toward said neck and wherein movement of said slide bar away from said neck causes said slide bar to bind on said opening of said braking lever, thereby preventing movement of said slide bar in a direction away from said neck.

5. The capo of claim 3 wherein pivoting of said braking lever against said biasing means is operative to allow relatively unrestricted movement of said slide bar through said opening in a direction toward said neck and in a direction away from said neck.

6. A capo for fretting an instrument having a neck and strings, comprising:

a barr member for fretting said strings;

a housing member coupled to said barr member;

a forcing member for engaging said neck on a side of said neck substantially opposite said strings;

a slide bar coupled to said forcing member;

first biasing means disposed between said housing and said slide bar and operable to bias said slide bar in a direction away from said neck;

a detent located in said housing member;

at least one notch in said slide bar wherein said notch is positioned to engage said detent at at least one predetermined position of said slide bar; and second biasing means operable to bias said detent in a direction toward said notch when said detent and said notch are aligned.

7. The capo of claim 6, which further includes releasable locking means comprising a lever coupled to said detent.

8. The capo of claim 7 wherein movement of said lever in a direction operable to move said detent away from said notch is operative to allow relatively unrestricted movement of said slide bar in a direction toward said neck and in a direction away from said neck.

* * * * *